US010405641B2

(12) United States Patent
Waguespack

(10) Patent No.: US 10,405,641 B2
(45) Date of Patent: Sep. 10, 2019

(54) ORAL CARE IMPLEMENT

(71) Applicant: COLGATE-PALMOLIVE COMPANY, New York, NY (US)

(72) Inventor: Kenneth Waguespack, North Brunswick, NJ (US)

(73) Assignee: Colgate-Palmolive Company, New York, NY (US)

( * ) Notice: Subject to any disclaimer, the term of this patent is extended or adjusted under 35 U.S.C. 154(b) by 365 days.

(21) Appl. No.: 15/313,593

(22) PCT Filed: May 29, 2014

(86) PCT No.: PCT/US2014/039920

§ 371 (c)(1),
(2) Date: Nov. 23, 2016

(87) PCT Pub. No.: WO2015/183272

PCT Pub. Date: Dec. 3, 2015

(65) Prior Publication Data

US 2017/0150809 A1 Jun. 1, 2017

(51) Int. Cl.
*A46B 3/06* (2006.01)
*A46B 9/04* (2006.01)
(Continued)

(52) U.S. Cl.
CPC ..... *A46B 9/025* (2013.01); *A46B 3/06* (2013.01); *A46B 9/04* (2013.01); *A46D 1/0276* (2013.01);
(Continued)

(58) Field of Classification Search
CPC .... A46B 3/00; A46B 3/02; A46B 3/04; A46B 3/06; A46B 9/025; A46B 9/028; A46B 9/04
(Continued)

(56) References Cited

U.S. PATENT DOCUMENTS 560,663 A 5/1896 Wallas
2,209,173 A 7/1940 Young
(Continued)

FOREIGN PATENT DOCUMENTS

CN 2143429 Y 10/1993
DE 102007006950 8/2008
(Continued)

OTHER PUBLICATIONS

International Search Report and the Written Opinion of the International Searching Authority issued in international application PCT/US2014/039920 dated Aug. 4, 2014.

*Primary Examiner* — Mark Spisich

(57) ABSTRACT

An oral care implement having a tuft hole with inclined walls. In one aspect, the invention can be an oral care implement comprising: a head having a front surface and a rear surface; a tuft hole in the front surface of the head, the tuft hole extending along a central axis, the tuft hole comprising a first sidewall and a second sidewall opposite the first sidewall, each of the first and second sidewalls comprising an inclined section that converges toward a central plane that comprises the central axis with decreasing distance from the front surface; and a bristle tuft formed by a plurality of bristles, each of the plurality of bristles having a first portion disposed within the tuft hole and a second portion protruding from the front surface of the head, the second portions of the plurality of bristles converging toward the central plane.

18 Claims, 5 Drawing Sheets

(51) Int. Cl.
*A46B 9/02* (2006.01)
*A46D 1/00* (2006.01)

(52) U.S. Cl.
CPC . *A46B 2200/108* (2013.01); *A46B 2200/1066* (2013.01)

(58) Field of Classification Search
USPC ..... 15/167.1, 191.1, 192, 193
See application file for complete search history.

(56) References Cited

U.S. PATENT DOCUMENTS

| | | | | |
|---|---|---|---|---|
| 2,476,201 | A | 7/1949 | Ligoure | |
| 4,081,877 | A | 4/1978 | Vitale | |
| 4,570,282 | A | 2/1986 | Kaufman et al. | |
| 4,729,142 | A | 3/1988 | Yoshioka | |
| 5,042,107 | A | 8/1991 | Gregory et al. | |
| 6,665,901 | B2 | 12/2003 | Driesen et al. | |
| 8,042,217 | B2 | 10/2011 | Sorrentino | |
| 8,434,190 | B2 | 5/2013 | Stief et al. | |
| 2005/0071940 | A1 | 4/2005 | Hohlbein et al. | |
| 2005/0172436 | A1 | 8/2005 | Wineberg | |
| 2010/0050356 | A1* | 3/2010 | Baertschi | A46B 9/005 15/167.1 |
| 2010/0227478 | A1 | 9/2010 | Harada | |
| 2013/0333132 | A1* | 12/2013 | Loetscher | A46B 3/00 15/167.1 |
| 2015/0327665 | A1* | 11/2015 | Hohlbein | A46B 9/025 15/105 |

FOREIGN PATENT DOCUMENTS

| | | | |
|---|---|---|---|
| EP | 1 310 187 | | 5/2003 |
| FR | 2502918 | | 10/1982 |
| GB | 440 630 | | 1/1936 |
| GB | 469 566 | | 7/1937 |
| JP | 2003-19030 | * | 1/2003 |
| JP | 2009-050607 A | | 3/2009 |
| WO | 2001/089344 | | 11/2001 |
| WO | WO2010/023581 | | 3/2010 |

* cited by examiner

ORAL CARE IMPLEMENT

BACKGROUND

A toothbrush is used to clean the teeth by removing plaque and debris from the tooth surfaces. Conventional toothbrushes having a flat bristle trim are limited in their ability to conform to the curvature of the teeth, to penetrate into the interproximal areas between the teeth, to sweep away the plaque and debris, and to clean along the gum line. Additionally, such toothbrushes have a limited ability to retain dentifrice for cleaning the teeth. During the brushing process, the dentifrice typically slips through the tufts of bristles and away from the contact between the bristles and the teeth. As a result, the dentifrice is often spread around the mouth, rather than being concentrated on the contact of the bristles with the teeth. Therefore, the efficiency of the cleaning process is reduced.

While substantial efforts have been made to modify the cleaning elements of toothbrushes to improve the efficiency of the oral cleaning process, the industry continues to pursue arrangements of cleaning elements that will improve upon the existing technology. In typical oral care implements, bristles having circular transverse cross-sectional profiles are bundled together in a bristle tuft and mounted within tuft holes having circular transverse cross-sectional profiles. However, such a configuration results in gaps being present between adjacent bristles in the tuft and between the bristles of the tuft and the walls of the tuft holes, thereby resulting in a looser packing of the tuft hole and a less than optimal packing factor. These gaps can also reduce the effectiveness of the oral care implement and can cause the oral care implement to effectuate an uncomfortable feeling during brushing.

Therefore, a need exists for an oral care implement having an improved arrangement of bristles.

BRIEF SUMMARY

The present invention is directed to an oral care implement that includes a head with front and rear surfaces. The head includes a tuft hole that extends along a central axis. The tuft hole has sidewalls that include inclined portions that converge towards each other with decreasing distance from the front surface of the head. A bristle tuft is positioned within the tuft hole such that the sidewalls urge the bristle tufts into an inclined and converging orientation.

In one aspect, the invention can be an oral care implement comprising: a head having a front surface and a rear surface; a tuft hole in the front surface of the head, the tuft hole extending along a central axis, the tuft hole comprising a first sidewall and a second sidewall opposite the first sidewall, each of the first and second sidewalls comprising an inclined section that converges toward a central plane that comprises the central axis with decreasing distance from the front surface; and a bristle tuft formed by a plurality of bristles, each of the plurality of bristles having a first portion disposed within the tuft hole and a second portion protruding from the front surface of the head, the second portions of the plurality of bristles converging toward the central plane.

In another aspect, the invention can be an oral care implement comprising: a head having a front surface and a rear surface; a tuft hole in the front surface of the head, the tuft hole extending along a central axis; and a bristle tuft formed by a plurality of bristles, each of the plurality of bristles having a first portion disposed within the tuft hole and a second portion protruding from the front surface of the head; and wherein the second portions of the plurality of bristles converge toward a central plane that comprises the central axis with increasing distance from the front surface.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
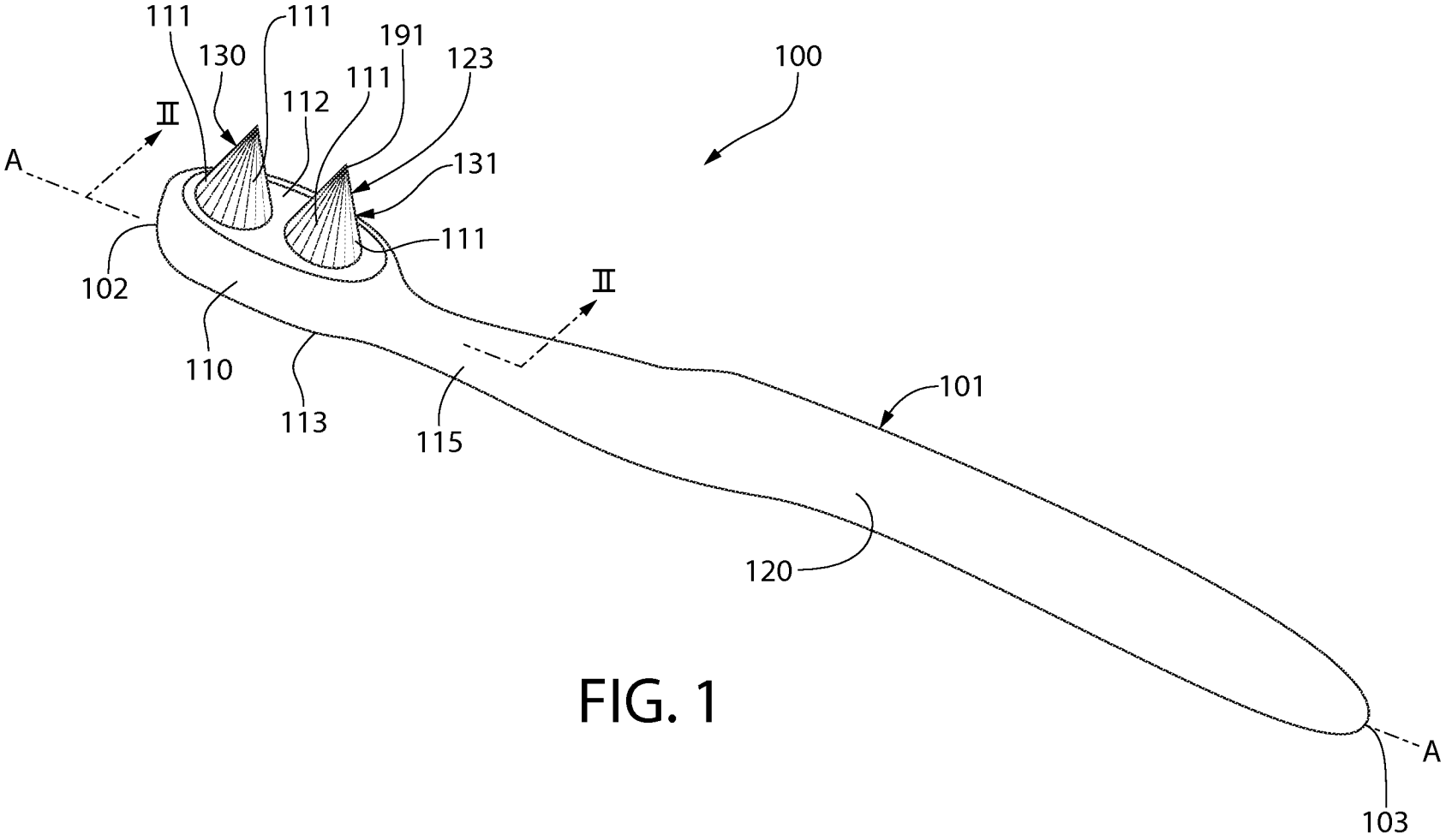
FIG. 1 is a front perspective view of an oral care implement having tufts of bristles in accordance with a first embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Referring first to FIG. 1, an oral care implement 100 is illustrated in accordance with one embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, a refill head for an electric toothbrush, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims.

The oral care implement extends from a proximal end 103 to a distal end 102 along a longitudinal axis A-A. The oral care implement 100 generally includes an elongated body 101 comprising a head 110, a neck 115 and a handle 120. The handle 120 is an elongated structure that provides the mechanism by which the user can hold and manipulate the oral care implement 100 during use. In the exemplified embodiment, the handle 120 is generically depicted having various contours for user comfort. More specifically, in the exemplified embodiment the handle 120 is bulbous shaped and has a larger diameter in a central region than near the proximal end 103 and neck 115. Specifically, a region of the handle 120 that would normally be gripped by a user's thumb has a width that is greater than a width of the neck 115. Of course, the invention is not to be so limited in all embodiments and in certain other embodiments the handle 120 can take on a wide variety of shapes, contours and configurations, none of which are limiting of the present invention unless so specified in the claims.

In the exemplified embodiment, the handle 120 is formed of a rigid plastic material, such as for example without limitation polymers and copolymers of ethylene, propylene, butadiene, vinyl compounds and polyesters such as polyethylene terephthalate. Of course, the invention is not to be so limited in all embodiments and the handle 120 may include a resilient material, such as a thermoplastic elastomer, as a grip cover that is molded over portions of or the entirety of the handle 120 to enhance the gripability of the handle 120 during use. For example, portions of the handle 120 that are typically gripped by a user's palm during use may be overmolded with a thermoplastic elastomer or other resilient material to further increase comfort to a user. Furthermore, materials other than those noted above can be used including metal, wood or any other desired material that has sufficient structural rigidity to permit a user to grip the handle 120 and manipulate the oral care implement 100 during toothbrushing.

The head 110 of the oral care implement 100 is coupled to the handle 120 and comprises a front surface 112 and an opposing rear surface 113. In the exemplified embodiment, the head 110 is formed integrally with the handle 120 as a single unitary structure using a molding, milling, machining or other suitable process. However, in other embodiments the handle 120 and the head 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners.

In the exemplified embodiment, the head 110 of the oral care implement 100 is provided with a first bristle tuft 130 and a second bristle tuft 131. Although depicted with two bristle tufts 130, 131, the invention is not to be so limited in all embodiments and more than two bristle tufts or just a single bristle tuft can be used in other embodiments. Specifically, in certain embodiments the oral care implement 100 may include multiple rows of the bristle tufts having the configuration, shape and orientation as discussed herein. Specifically, the bristle tufts described herein can be arranged in 5×5 arrays, 5×9 arrays, 3×6 arrays or any other desired configuration of rows and columns of the bristle tufts. In other embodiments, the bristle tufts described herein may be used on a toothbrush along with other cleaning elements and/or bristle tufts having other shapes, configurations or materials. In certain embodiments, an oral care implement may include only bristle tufts having a conical configuration as disclosed herein.

Furthermore, in the exemplified embodiment each of the first and second bristle tufts 130, 131 are identical in appearance and they are aligned along the longitudinal axis A-A. In that regard, each of the first and second bristle tufts 130, 131 are conical in shape (i.e., cone-shaped tufts) or have conically shaped portions. As a result of this cone-like shape, the tips of the bristles of the tufts converge together into a dense grouping at the terminal end of the tuft furthest from the front surface 112 of the head 110. This dense grouping of the bristles at this location can enhance cleaning effects by having more bristle tips effectively cleaning a pinpoint location on a user's teeth simultaneously.

The exact shape of the first and second bristles tufts 130, 131 will be discussed in more detail below with reference to FIGS. 2A, 2B and 3. It will be appreciated that the shape of the tuft hole within which the bristle tufts 130, 131 are positioned dictate the shape of the bristle tufts 130, 131 by urging the bristles of the bristle tufts 130, 131 to be oriented in a specific manner. As noted above, the invention is not limited to a toothbrush having only bristle tufts with the shape and appearance of the first and second bristle tufts 130, 131, and in certain embodiments additional bristles, bristle tufts or other cleaning elements can be included on the head with one or both of the first and second bristles tufts 130, 131 or with an array of the bristle tufts.

Each of the first and second bristle tufts 130, 131 comprises and is formed by a plurality of tooth cleaning elements 111, only a few of which are labeled in the figures to avoid clutter. More specifically, in the exemplified embodiment each of the tooth cleaning elements is a bristle, and thus each of the first and second bristle tufts 130, 131 is formed by a plurality of the bristles. In the exemplified embodiment, each of the bristles is a tapered bristle, the details of which will be described in more detail below with reference to FIG. 4. However, the invention is not to be so limited in all embodiments and the tooth cleaning elements 111 can take on other forms.

Specifically, in certain embodiments the term "tooth cleaning elements" may be used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Thus, any combination of these tooth cleaning elements may be used within the first and second bristle tufts 130, 131 in some embodiments.

Suitable elastomeric materials for use when the tooth cleaning elements include elastomeric protrusions include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 111 of the present invention can be connected to the head 110 in any manner known in the art. For example, staples/anchors, in-mold tufting (IMT) or anchor free tufting (AFT) could be used to mount the cleaning elements/tooth engaging elements. In certain embodiments, the invention can be practiced with various combinations of stapled, IMT or AFT bristles. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Two particular embodiments utilizing AFT will be described herein with reference to FIGS. 2A and 2B. Any suitable form of cleaning elements may be used in the broad practice of certain embodiments of this invention. In some embodiments, the bristles could be mounted to tuft blocks or sections by extending through suitable openings in the tuft blocks so that the base of the bristles is mounted within or below the tuft block.

Although not illustrated herein, in certain embodiments the head 110 may also include a soft tissue cleanser coupled to or positioned on its rear surface 113. An example of a suitable soft tissue cleanser that may be used with the present invention and positioned on the rear surface of the head 110 is disclosed in U.S. Pat. No. 7,143,462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the oral care implement 100 may not include any soft tissue cleanser.

Figure 2A:
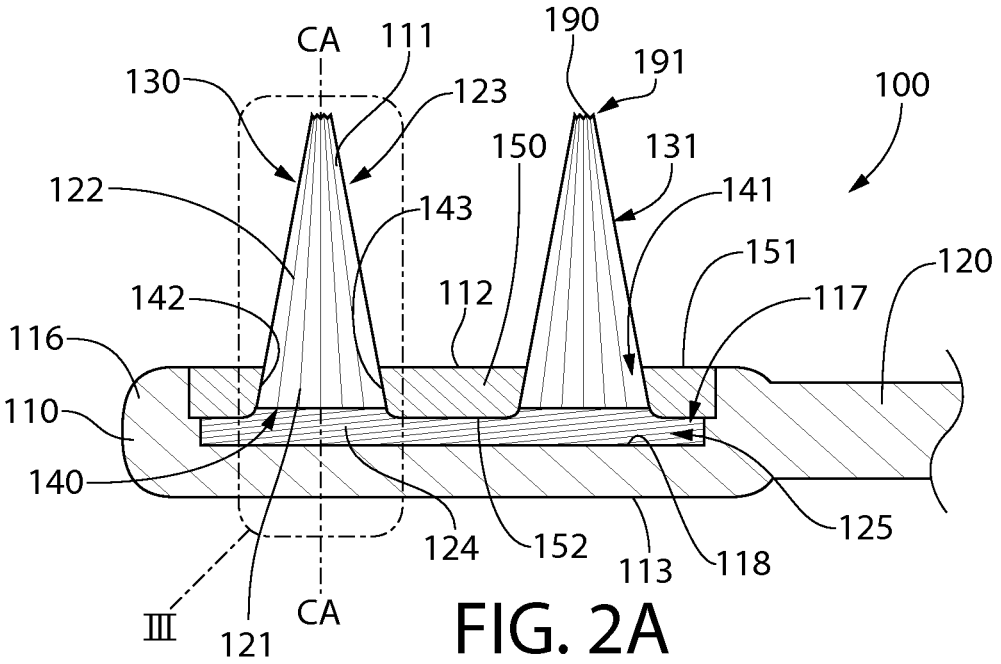
FIG. 2A is a cross-sectional view taken along line II-II of FIG. 1 in accordance with one embodiment of the present invention.
Figure 3:
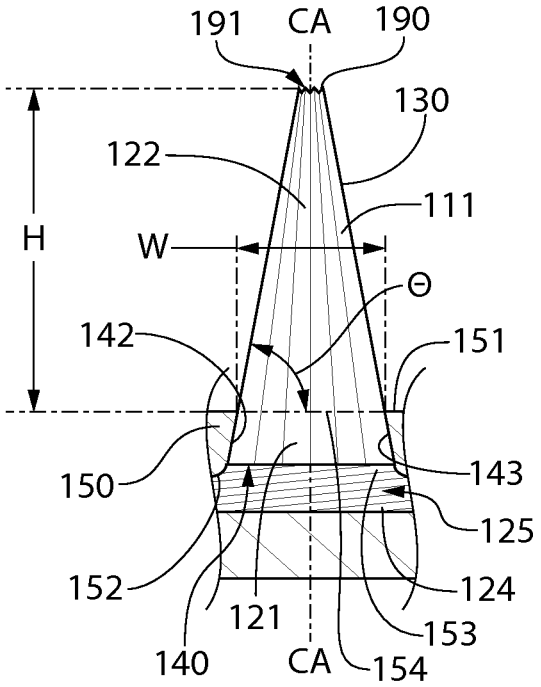
FIG. 3 is a close-up view of area III of FIG. 2A.

Referring to FIGS. 1, 2A and 3 concurrently, the oral care implement 100 will be further described. In the exemplified embodiment, the oral care implement 100 comprises a first tuft hole 140 and a second tuft hole 141 in the front surface 112 of the head 110. Although two tuft holes 140, 141 are depicted in the drawings, as discussed above it should be appreciated that more or less than two tuft holes can be used depending on the number of bristle tufts that are desired to be coupled to the head 110. Various arrangements of the tuft holes are possible in different configurations along the front surface 112 of the head 110. The two tuft hole arrangement is used in the drawings herein to avoid clutter. The details of the first tuft hole 140 will be described herein below, it being understood that the same description is applicable to the structure, shape and arrangement of the second tuft hole 141 and other tuft holes that may be included as desired.

The first tuft hole 140 is formed into the front surface 112 of the head 110 and extends along a central axis CA-CA. In the exemplified embodiment, the central axis CA-CA of the tuft hole 140 is oriented substantially perpendicular to the front surface 112 of the head 110. Furthermore, the invention is not limited in all embodiments to the perpendicular orientation of the central axis CA-CA and the central axis CA-CA of the tuft hole 140 may be inclined relative to the front surface 112 of the head 110 in other embodiments. By inclining the central axis CA-CA of the tuft hole 140 relative to the front surface 112 of the head 110, bristle tufts positioned within the tuft hole 140 may be similarly inclined relative to the front surface 112 of the head 110.

In the exemplified embodiment, the first tuft hole 140 comprises a first sidewall 142 and a second sidewall 143 opposite the first sidewall 142. Furthermore, in the exemplified embodiment each of the first and second sidewalls 142, 143 are oriented at an incline relative to the front surface 112 of the head 110. More specifically, each of the first and second sidewalls 142, 143 are inclined so as to converge towards a central plane that includes the central axis CA-CA with decreasing distance from the front surface 112 of the head 110. Thus, the nearer to the front surface 112 of the head 110, the closer the first and second sidewalls 142, 143 are to one another such that the distance between the first and second sidewalls 142, 143 increases with increasing distance from the front surface 112 of the head 110. Stated another way, the first and second sidewalls 142, 143 extend downwardly from the front surface 112 of the head 110 at an acute angle, the acute angle being between 60° and 89° in one embodiment, between 70° and 89° in another embodiment, and between 80° and 89° in yet another embodiment, and between 79° and 88° in a still further embodiment, or approximately 82.8°. Changing the acute angle correspondingly changes the collective shape of any bristle tuft positioned within the first tuft hole 140, as discussed in more detail below with reference to FIG. 3.

Due to the inclining nature of the first and second sidewalls 142, 143, the tuft hole 140 has a cross-sectional area measured transverse to the central axis CA-CA that decreases with decreasing distance from the front surface 112 of the head 110. Thus, the nearer to the front surface 112 of the head 110 that the transverse cross-section is taken, the less the area of the tuft hole 140 and the further from the front surface 112 of the head 110 that the transverse cross-section is taken, the greater the area of the tuft hole 140.

Although described herein such that the first and second sidewalls 142, 143 are inclined, in some embodiments, portions of the first and second sidewalls 142, 143 may be inclined while other portions of the first and second sidewalls 142, 143 are not inclined. In such an embodiment, the sidewalls 142, 143 may include a section furthest from the front surface 112 of the head 110 that is not inclined (i.e., perpendicular to the front surface 112 of the head 110) and a section that is nearest to the front surface 112 of the head 110 that is inclined as discussed above. Thus, in such an embodiment at least the section of the first and second sidewalls 142, 143 that extends to the front surface 112 of the head 110 is inclined as discussed herein.

Furthermore, in certain embodiments the first tuft hole 140 (and the second tuft hole 141) is defined by a continuous sidewall that circumscribes the central axis CA-CA and comprises the first and second sidewalls 142, 143. In such embodiment, the continuous sidewall has a continuous inclined section that circumscribes the central axis CA-CA and comprises the inclined first and second sidewalls 142 143 such that the entire sidewall (i.e., the entirety of the wall that defines and surrounds the tuft hole 140) is oriented so as to be inclined as discussed above with regard to the first and second sidewalls 142, 143.

As noted above, the oral care implement 100 includes the first bristle tuft 130 which is formed by a plurality of bristles 111. The first bristle tuft 130 is positioned within the first tuft hole 140 and coupled to the head 110 of the oral care implement 100. More specifically, each of the plurality of bristles 111 has a first portion 121 that is disposed within the first tuft hole 140 and a second portion 122 protruding from the front surface 112 of the head 110. Due to the inclined nature of the first and second sidewalls 142, 143, the first and second portions 121, 122 of each of the plurality of bristles 111 are oriented so as to converge toward the central plane that includes the central axis CA-CA. More specifically, the inclined portions of the first and second sidewalls 142, 143 urge the first portions 121 of the plurality of bristles 111 into an inclined orientation so that the second portions 122 of the plurality of bristles 111 converge toward the central plane.

In the embodiment exemplified in FIGS. 1-3, due to the urging of the inclined portions of the first and second sidewalls 142, 143 (and more specifically of the continuous sidewall that circumscribes the central axis CA-CA), the second portions 122 of the plurality of bristles 111 converge toward the central axis CA-CA to form a conical tuft section 123 of the first bristle tuft 140. Thus, the second portions 122 of the plurality of bristles 111 converge toward the central plane that includes the central axis CA-CA with increasing distance from the front surface 112 of the head 110. It should be appreciated that as used herein, the conical tuft section 123 is not limited to being purely conically shaped in all embodiments. Rather, the conical tuft section 123 may be pyramid shaped, truncated cone shaped, or otherwise similarly shaped in other embodiments. The inclined nature of the various sidewalls of the tuft hole 140 will dictate the ultimate shape of the bristle tuft 130 positioned within that tuft hole 140 due to the sidewalls of the tuft hole 140 urging the bristles 111 to incline, slant or not.

Referring to FIG. 3, various dimensions of the bristle tufts 130, 131 will be described when the bristle tufts 130, 131 are positioned within the tuft holes 140, 141 (described with regard to the bristle tuft 130 because that tuft is depicted in FIG. 3). Specifically, the second section 122 of the bristle tuft 130 has a height H and a width W. The height H is measured from the front surface 112 of the head 110 to the terminal end or tip of the bristle tuft 130. Thus, the height H is the height of the second section 122 of the bristle tuft 130 as it extends from the head 110 taking into consideration the inclined orientation of the bristles 111. The width W is measured at an opening 154 to the tuft hole 140 at the front surface 112 of the head 110. In certain embodiments, the height H is between 8 mm and 15 mm, and more specifically approximately 12 mm. Furthermore, in certain embodiments the width W is between 1 mm and 3 mm, and more specifically approximately 1.5 mm. Furthermore, the outer surface of the bristle tuft 130 is oriented at an acute angle Θ relative to the front surface 112 of the head 110 (and the front surface 151 of the plate 150 as depicted in FIG. 3). In certain embodiments, the angle Θ is between 79° and 88°, and more specifically between 80° and 85°, and still more specifically between 82° and 83°, and even more specifically approximately 82.8°.

There are several different ways in which the oral care implement 100 can be formed to include the bristle tufts as described herein. Referring briefly to FIGS. 2A and 3, one embodiment of the oral care implement 100 will be described. In the embodiment depicted in FIGS. 2A and 3, the head 110 of the oral care implement 100 comprises a base portion 116 that is integrally formed with the handle 120 of the oral care implement 100 as a single component. The base component 116 has a basin 117 formed therein. Furthermore, in this embodiment the oral care implement 100 comprises a plate 150 that is formed separately from the base component 116. The plate 150 comprises a front surface 151 and an opposing rear surface 152. The front surface 151 of the plate 150 forms at least a portion of the front surface 112 of the head 110.

In this embodiment, the handle 120 and base component 116 are formed, such as during an injection molding process or the like, and the plate 150 is separately formed, also during an injection molding process or the like. In this embodiment, the first and second tuft holes 140, 141 are formed into the plate 150. More specifically, each of the tuft holes 140, 141 extends from an opening 153 in the rear surface 152 of the plate to an opening 154 in the front surface 151 of the plate along the central axis CA-CA. Furthermore, in this embodiment each of the tuft holes 140, 141 comprise the sidewalls 142, 143 having inclined sections. Further still, in the exemplified embodiment the inclined sections of the sidewalls 142, 143 extend from the rear surface 152 of the plate 150 to the front surface 151 of the plate 150.

After formation of the plate 150, a plurality of the bristles 111 are clumped together to form the first bristle tuft 130. The first bristle tuft 130 including a collection of the bristles 111 is then inserted into the first tuft hole 140. In certain embodiments, the plurality of bristles 111 that form the first bristle tuft 130 are inserted into the first tuft hole 140 from the rear surface 152 of the plate 150. The plurality of bristles 111 that form the first bristle tuft 130 are inserted into the first tuft hole 140 until the first portion 121 of the bristles 111 is disposed within the first tuft hole 140 and the second portion 122 of the bristles 111 is protruding from the front surface 112 of the head 110. As the plurality of bristles 111 are inserted into the first tuft hole 140, the sidewalls 142, 143 of the first tuft hole 140 urge the bristles 111 towards one another so that they converge toward the central axis CA-CA to form the conical tuft section 123 as discussed above.

Furthermore, a third portion 124 of each of the plurality of bristles 111 is positioned so as to extend from the rear surface 152 of the plate 150. The third portions 124 of the plurality of bristles 111 are then fused together to form a unitary mass 125 that anchors the bristle tuft 130 to the plate 150. In one embodiment, the third portions 124 of the plurality of bristles 111 can be fused together to form the unitary mass 125 by melting the third portions 124 of the plurality of bristles 111 so that the third portions 124 combine to form a the unitary mass 125 (or melt matte) on the rear surface 152 of the plate 150. The third portions 124 of the plurality of bristles 111 can be melted by bringing a heating element into contact with the third portion 124 of the plurality of bristles 111, which fuses the third portions 124 of the plurality of bristles 111 together to form the unitary mass 125 (or melt matte). Alternatively, the third portions 124 of the plurality of bristles 111 can be melted by any means known for applying heat thereto, such as convective heated gas flow and/or irradiation. When the melt matte hardens, the first bristle tuft 130 is secured to plate 150 and cannot be pulled out though the front surface 151 of the plate 150.

After all desired bristle tufts are coupled to the plate 150 as discussed above, the plate 150 is positioned within the basin 117 and coupled to the base portion 116 so that the unitary mass 125 is positioned between a floor 118 of the basin 117 and the rear surface 152 of the plate 150. Once the plate 150 is positioned within the basin 117, the plate 150 can then be secured to the base portion 116 using a technique such as thermal welding, sonic welding, adhesion or the like. Of course, other techniques can be utilized such as snap fit, tight fit, interference fit, a keyed arrangement or the like.

Figure 2B:
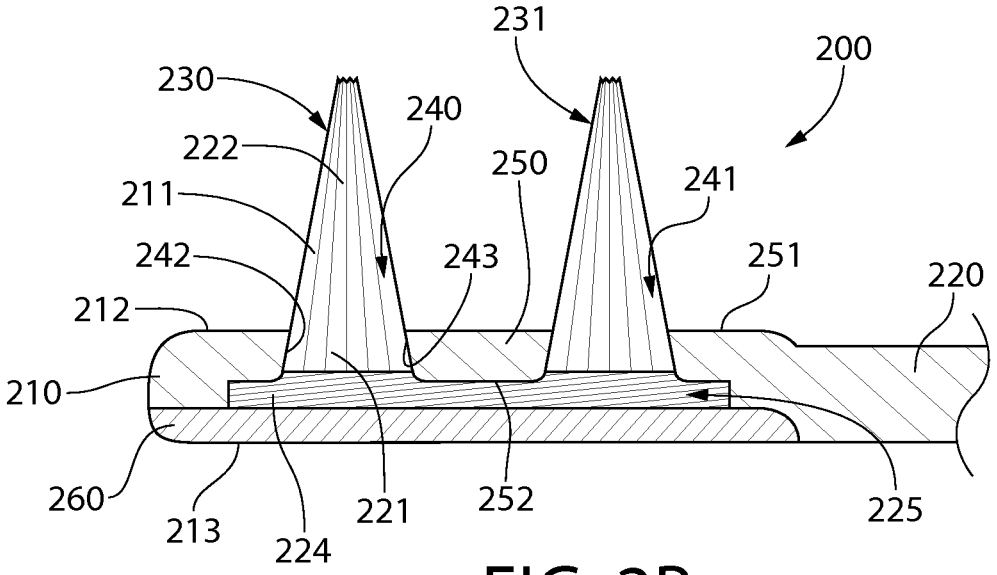
FIG. 2B is an alternative cross-sectional view taken along line II-II of FIG. 1 in accordance with another embodiment of the present invention.

Referring to FIG. 2B, an alternative structural arrangement will be described with reference to an oral care implement 200. Many features and components of the oral care implement 200 are similar to features and components of the oral care implement 100, and thus similar features will be similarly numbered except that the 200-series of numbers will be used. Certain features of the oral care implement 200 may not be numbered, it being understood that the description of that feature with respect to the oral care implement 100 applies. Furthermore, certain features of the oral care implement 200 may be numbered but not described, it being understood that the description of that feature with respect to the oral care implement 100 applies. It should be appreciated that various combinations of the features and components of the oral care implement 200 and the oral care implement 100 are possible within the scope of the present invention in some embodiments.

The oral care implement 200 comprises a handle 220 and a head 210. The head 210 is formed by a plate 250 and a second component 260. Similarly to the oral care implement 100, the plate 250 has tuft holes 240, 241 formed therein, and bristle tufts 230, 231 are inserted into the tuft holes 240, 241.

The difference between the oral care implement 200 and the oral care implement 100 is that with the oral care implement 200, the plate 250 is integrally formed with the handle 220 of the oral care implement as a single component. Thus, in this embodiment the handle 220 and the plate 250 are formed, such as in a single shot of an injection molding process. After the handle 220 and the plate 250 are formed, the bristles 211 of the bristle tufts 230, 231 are inserted into the tuft holes 240, 241 of the plate 250 in the same manner as discussed above with regard to FIGS. 2A and 3. Specifically, the bristles 211 of the bristle tufts 230 are inserted through the rear surface 252 of the plate 250 until the second portions 222 of the bristles 211 extend from the front surface 212 of the head 210, the first portions 221 of the bristles 211 are positioned within the tuft holes 240, and the third portions 224 of the bristles 211 extend from the rear surface 252 of the plate 250. The third portions 224 of the bristles 211 are then melted together in the manner discussed above.

After the third portions 224 of the bristles 211 are melted together to secure the bristle tufts 230, 231 to the head 210, the second component 260 of the head 210 is coupled to the plate 250 and/or to the handle 220. In this embodiment, the second component 260 of the head 210 comprises a rear portion of the head 210 that includes the rear surface 213 of the head 210. Furthermore, in this embodiment the second component 260 covers the unitary mass 225 (or melt matte) of the bristles 211. The second component 260 may be adhered to the plate 250 during a second injection molding process or using adhesion, fasteners, thermal or sonic welding or the like.

Referring again to FIGS. 1, 2A and 3, the oral care implement 100 will be further described. It should be appreciated that the description of the oral care implement 100 that follows is also applicable to the oral care implement 200. In the exemplified embodiment, the second portions 122 of the plurality of bristles 111 comprise free ends 190 of the plurality of bristles 111. Furthermore, in the exemplified embodiment the free ends 190 of the second portions 122 of the plurality of bristles 111 collectively form a terminal apex 191 of the first and second bristles tufts 130, 131. The term "apex" is merely intended to mean the top or highest point of the first and second bristle tufts 130, 131 and does not necessary mean that the first and second bristle tufts 130, 131 terminate at a point. Rather, the terminal apex 191 can be wider than a narrow point due to being formed by the free ends 190 of the plurality of bristles 111 that are within the bristle tuft 130, 131.

The collection of the free ends 190 of the plurality of bristles 111 at the apex 191 forms a concentrated region of the bristles 111 (which in one embodiment may include or consist of tapered bristles) at the terminal apex 191. This concentrated region of the bristles 111 can be effective at scraping plaque and bacteria from the outer surfaces of the teeth because there are more bristle tips positioned in one area (higher concentration of bristles results in more strength for cleaning teeth). Furthermore, when the bristles 111 are tapered bristles they can still effectively penetrate into the tight spaces between adjacent teeth.

Figure 5:
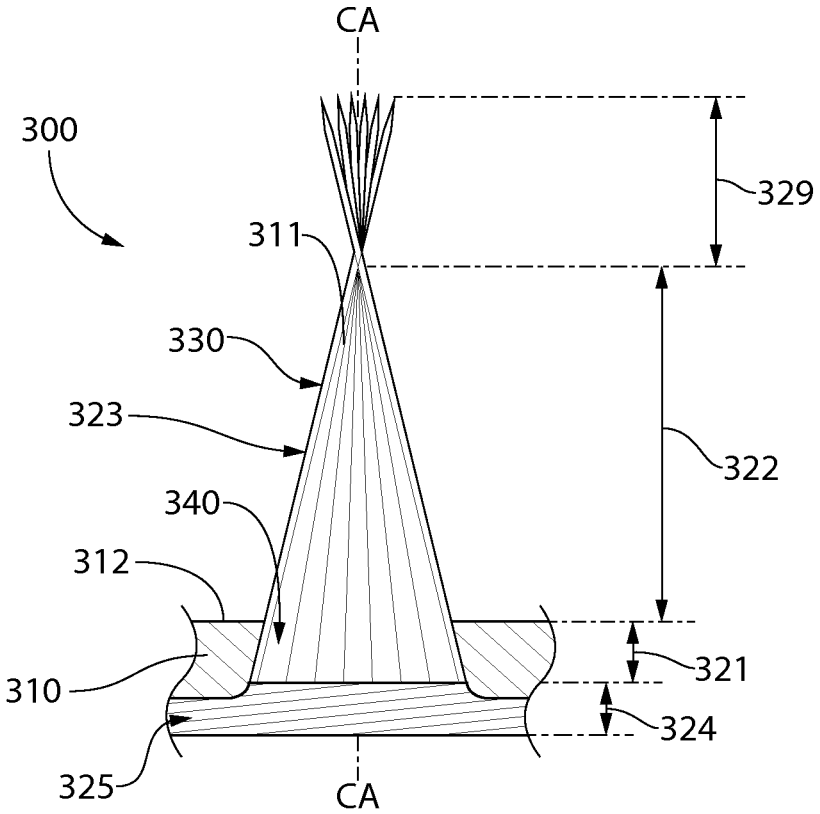
FIG. 5 is an alternative close-up cross-sectional view of one of the tufts of bristles of FIG. 1.

Referring to FIG. 5, another embodiment of a portion of an oral care implement 300 will be described. Again, many features and components of the oral care implement 300 are similar to those already described herein above with regard to the oral care implements 100, 200. Thus, certain features of the oral care implement 300 will not be described herein but will be similarly numbered as with the oral care implements 100, 200 except that the 300-series of numbers will be used, it being understood that the description of the oral care implements 100, 200 above applies to those features and components.

The oral care implement 300 has a tuft hole 340 and a bristle tuft 330 that is formed by a plurality of bristles 311 positioned within the tuft hole 340. The tuft hole 340 may have the configuration of the tuft holes 140, 141 described above including inclined sidewalls as described above. The difference between the oral care implement 300 and the oral care implements 100, 200 is with the bristle tuft 330. Specifically, each of the plurality of bristles 311 of the bristle tuft 330 includes a first portion 321 that is disposed within the tuft hole 330, a second portion 322 that extends from the front surface 312 of the head 310, and a third portion 324 that is fused together to form the unitary mass or melt matte 325. Similar to the discussion above, the second portions 322 of the plurality of bristles 311 of the bristle tuft 330 collectively form the conical tuft section 323 of the bristle tuft 330.

In addition to the above sections, each of the bristles 311 of the bristle tuft 330 also includes a fourth section 329. The fourth section 329 of the plurality of bristles 311 of the bristle tuft 330 extends from the second section 322 of the plurality of bristles 311 of the bristle tuft 330. Furthermore, the fourth section 329 of the plurality of bristles 311 of the bristle tuft 330 diverge from the central plane that includes the central axis CA-CA. Thus, the bristles 311 of the bristle tuft 300 extend from the front surface 312 of the head such that the second sections 322 of the bristles 311 converge towards the central plane that includes the central axis CA-CA and then the fourth sections 329 of the bristles 311 diverge away from the central plane that includes the central axis CA-CA.

In certain embodiments, the bristles 111 of the bristle tufts 130, 131 may comprise tapered bristles. Thus, some of the bristles 111 of each of the bristle tufts 130, 131 may be a tapered bristle. In other embodiments, all of the bristles 111 of the bristle tufts 130, 131 are tapered bristles. Each of FIGS. 1-3 and 5 illustrate the bristle tufts including only tapered bristles, although some non-tapered bristles (i.e., cylindrical bristles) may be included with the tufts as desired.

Figure 4:
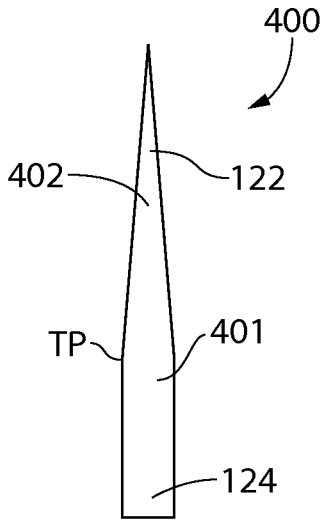
FIG. 4 is a front view of a tapered bristle in accordance with an embodiment of the present invention.

One exemplary embodiment of a tapered bristle 400 is illustrated in FIG. 4 and will be discussed below. In the exemplified embodiment, the tapered bristle 400 has a non-tapered section 401 and a tapered section 402. Specifically, the tapered bristle 400 extends along a longitudinal axis, and each of the non-tapered and tapered sections 401, 402 form a part of the longitudinal length of the tapered bristle 400. The non-tapered section 401 of the tapered bristle 400 is cylindrical in shape and includes the third portion 124 of the tapered bristle 400. The first portion 121 of the tapered bristle 400 may be positioned along either of the non-tapered or tapered sections 401, 402 of the tapered bristle 400. Furthermore, the second portion 122 of the tapered bristle 400 comprises the tapered section 402 of the tapered bristle 400. The tapered section 402 of the tapered bristle 400 may also comprise a portion of the first portion 121 of the tapered bristle 400. Thus, in some embodiments only tapered portions 402 of the tapered bristle 400 extend from the front surface 112 of the head 110. In other embodiments a portion of the non-tapered portion 401 of the tapered bristle 400 may also extend from the front surface 112 of the head 110.

The non-tapered section 401 of the tapered bristle 400 extends from the third portion 124 to a transition point TP. At the transition point TP, the cross-sectional profile of the tapered bristle 400 begins to gradually decrease with distance from the transition point TP in a direction away from the third portion 124 of the tapered bristle 400 and towards the tip of the tapered bristle 400. Thus, in the exemplified embodiment the tapered bristle 400 does not taper or gradually reduce its cross-sectional profile along its entire length, but only from the transition point TP to the tip. However, the invention is not to be so limited and in certain other embodiments one or more of the tapered bristles may taper along its entire length, such as that illustrated in FIGS. 2A and 2B. Stated another way, in certain embodiments each of the first and second sections 401, 402 of the tapered bristle 400 may be tapered or gradually reduced in cross-sectional area.

Figure 6:
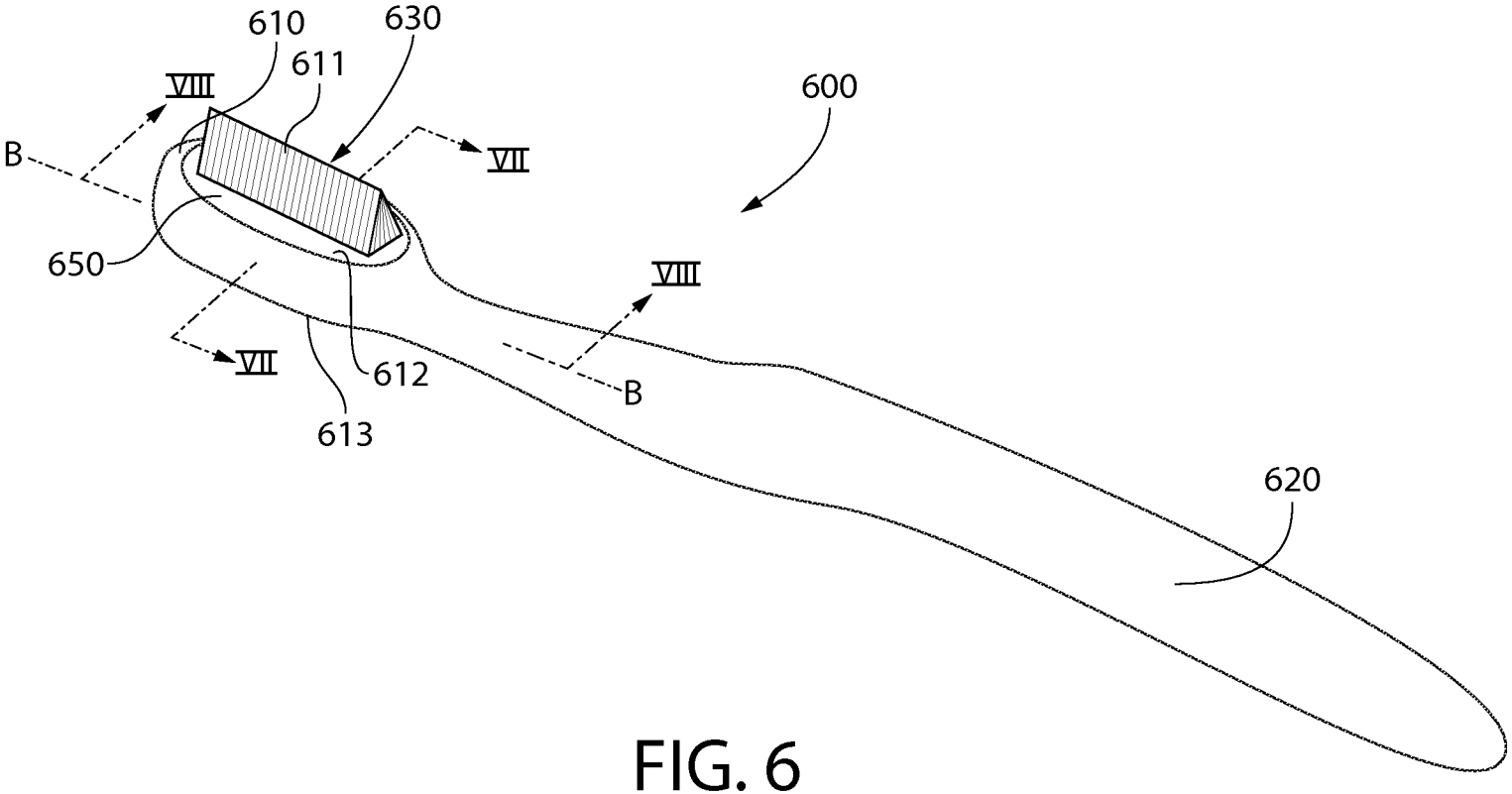
FIG. 6 is a front perspective view of an oral care implement having a tuft of bristles in accordance with a second embodiment of the present invention.
Figure 7:
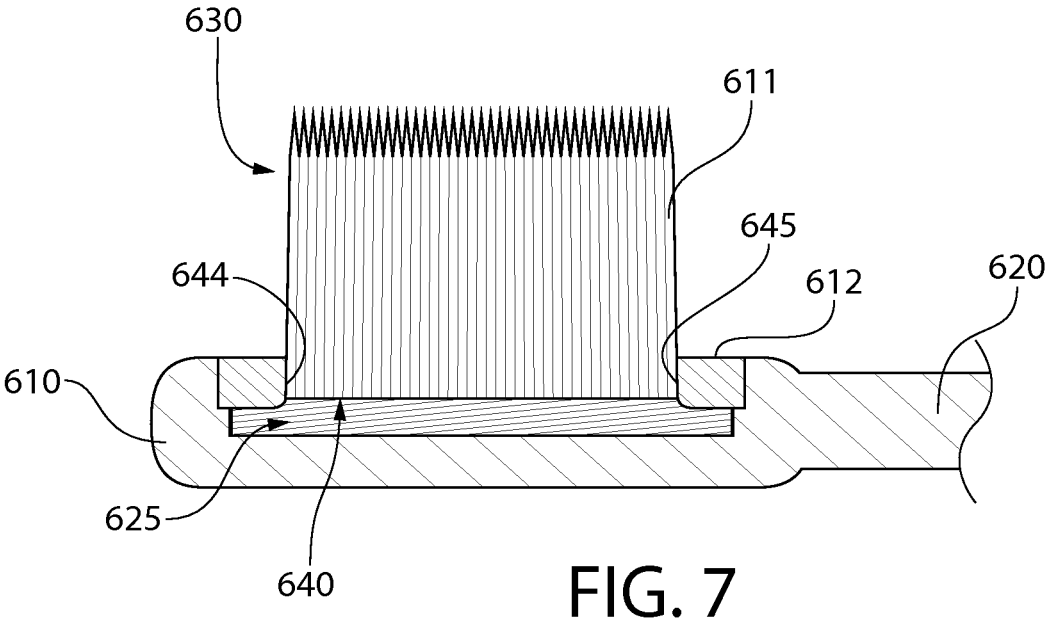
FIG. 7 is a cross-sectional view taken along line VII-VII of FIG. 6.
Figure 8:
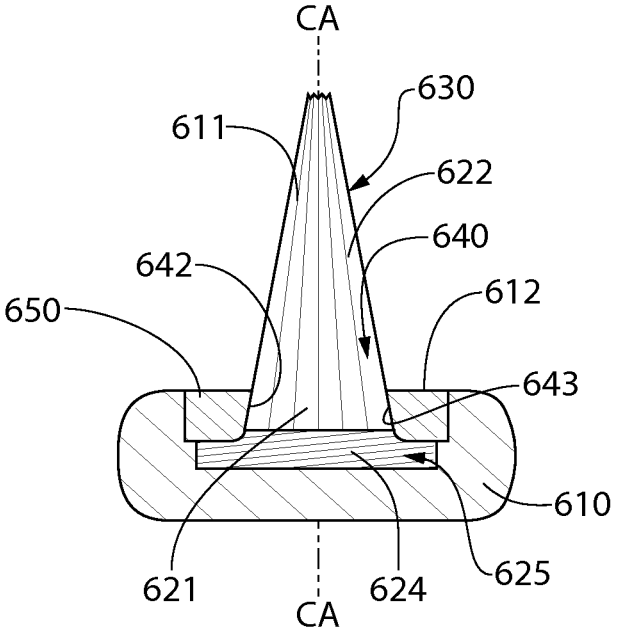
FIG. 8 is a cross-sectional view taken along line VIII-VIII of FIG. 6.

Referring now to FIGS. 6-8 concurrently, an oral care implement 600 is illustrated in accordance with another embodiment of the present invention. The oral care implement 600 is similar to the oral care implement 100 in many aspects, and thus each will be similarly numbered except that the 600-series of numbers will be used to describe the features and components of the oral care implement 600. Certain features and components of the oral care implement 600 may not be illustrated or may be illustrated and not described and for those features and components the description of the similar feature and component with regard to the oral care implement 100 may apply. Furthermore, certain features and components of the oral care implement 600 may be numbered but not described, it being understood that the feature or component with the same number in the 100-series from the description of the oral care implement 100 applies. Various combinations of the description above with regard to the oral care implement 100 and the description below 600 may form a part of the present invention.

The oral care implement 600 generally comprises a handle 620 and a head 610. The head 610 has a front surface 612 and an opposing rear surface 613. In the exemplified embodiment, a portion of the head 610 is formed by a plate 650 such as the plate 150 discussed in detail above with regard to the oral care implement 100. Of course, any of the formation techniques described above, particularly those described with reference to FIGS. 2A and 2B, can be utilized with the oral care implement 600.

The oral care implement 600 comprises a tuft hole 640. In this embodiment, the tuft hole 640 extends along a central axis CA. Furthermore, the tuft hole 640 has a first sidewall 642 and a second sidewall 643 opposite the first sidewall 642. Each of the first and second sidewalls 642, 643 is or has a section that is oriented at an incline relative to the front surface 612 of the head 610 such that each of the first and second sidewalls 642, 643 converges towards a central plane that comprises the central axis CA-CA. The inclined nature of the sidewalls 642, 643 is the same or similar to that which has been described above with regard to the sidewalls 142, 143.

In the embodiment of FIGS. 6-8, the tuft hole 640 also includes a third sidewall 644 and a fourth sidewall 645 (see FIG. 7). In the exemplified embodiment, each of the third sidewall 644 and the fourth sidewall 645 are oriented substantially perpendicular to the front surface 612 of the head 610. Thus, differently than the tuft hole 140 of the oral care implement 100 wherein a continuous sidewall of the tuft hole 140 is inclined, in the oral care implement 600 some of the sidewalls 642, 643 are inclined and others of the sidewalls 644, 645 are not inclined. The tuft hole 640 is rectangular or square in shape rather than circular in shape as with the tuft hole 140.

In the exemplified embodiment, the first and second sidewalls 642, 643, which are inclined, are elongated along a longitudinal axis B-B of the head 610. Furthermore, the third and fourth sidewalls 644, 645 extend between the first and second sidewalls 642, 643. Furthermore, in the oral care implement 600 a bristle tuft 630 comprising a plurality of bristles 611 is positioned within the tuft hole 640. As the bristle tuft 630 is inserted into the tuft hole 640, the first and second sidewalls 642, 643 of the tuft hole 640 urge first portions 621 of the plurality of bristles 611 into an inclined orientation so that second portions 622 of the plurality of bristles 611 converge toward the central plane.

In the exemplified embodiment the tuft hole 640 is elongated along the central plane and the second portions 622 of the bristles 611 of the bristle tuft 630 converge toward the central plane. Due to this arrangement, the bristle tuft 630 forms an elongated wall section having a triangular cross-section taken transverse to the central plane and parallel to the central axis CA-CA. This triangular cross-section is achieved due to the first and second sidewalls 642, 643 being inclined and the third and fourth sidewalls 644, 645 being perpendicular relative to the front surface 612 of the head 610. Of course, different variations of degree of incline of the various sidewalls and different combinations of inclined and perpendicular sidewalls can be used to achieve different overall cross-sectional shapes of the bristle tuft 630.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a head having a front surface and a rear surface;

a tuft hole in the front surface of the head, the tuft hole extending along a central axis, the tuft hole comprising a first sidewall and a second sidewall opposite the first sidewall, each of the first and second sidewalls comprising an inclined section that converges toward a central plane that comprises the central axis with decreasing distance from the front surface;

a bristle tuft formed by a plurality of bristles, each of the plurality of bristles having a first portion disposed within the tuft hole and a second portion protruding from the front surface of the head, the second portions of the plurality of bristles converging toward the central plane;

a continuous sidewall that circumscribes the central axis and comprises the first and second sidewalls, the continuous sidewall comprising a continuous inclined section that circumscribes the central axis and comprises the inclined sections of the first and second sidewalls; and wherein the second portions of the plurality of bristles converge toward the central axis to form a conical tuft section of the bristle tuft.

2. The oral care implement according to claim 1 wherein the inclined portions of the first and second sidewalls urge the first portions of the plurality of bristles into an inclined orientation so that the second portions of the plurality of bristles converge toward the central plane.

3. The oral care implement according to claim 1 wherein the plurality of bristles comprises tapered bristles.

4. The oral care implement according to claim 1 further comprising:

the head comprising a plate, the plate comprising a front surface and a rear surface, the front surface of the plate forming at least a portion of the front surface of the head;

the plate comprising the tuft hole; and each of the plurality of bristles comprising a third portion, the third portions of the plurality of bristles fused together to form a unitary mass that anchors the bristle tuft to the plate.

5. The oral care implement according to claim 4 wherein the tuft hole extends from an opening in the rear surface of the plate to an opening in the front surface of the plate along the central axis, and wherein each of the inclined sections of the first and second sidewalls extends from the rear surface of the plate to the front surface of the plate.

6. The oral care implement according to claim 1 further comprising:

the tuft hole being elongated along the central plane; and wherein the second portions of the plurality of bristles converge toward the central plane to form an elongated wall section having a triangular cross-section taken transverse to the central plane and parallel to the central axis.

7. The oral care implement according to claim 1 wherein the second portions of the plurality of bristles comprise free ends of the plurality of bristles, wherein the free ends of the second portions of the plurality of bristles collectively form a terminal apex of the bristle tuft.

8. The oral care implement according to claim 1 wherein each of the plurality of bristles further comprises a third portion extending from the second portion, the third portions of the plurality of bristles diverging from the central plane.

9. The oral care implement according to claim 1 wherein the central axis of the tuft hole is substantially perpendicular to the front surface of the head.

10. The oral care implement according to claim 1 wherein the central axis of the tuft hole is inclined relative to the front surface of the head.

11. The oral care implement according to claim 1 wherein the tuft hole has a cross-sectional area measured transverse to the central axis that decreases with decreasing distance from the front surface.

12. An oral care implement comprising:

a head having a front surface and a rear surface;

a tuft hole in the front surface of the head, the tuft hole extending along a central axis; and a bristle tuft formed by a plurality of bristles, each of the plurality of bristles having a first portion disposed within the tuft hole and a second portion protruding from the front surface of the head; and a continuous sidewall that circumscribes the central axis, the continuous sidewall comprising a continuous inclined section that circumscribes the central axis;

wherein the second portions of the plurality of bristles converge toward a central plane that comprises the central axis with increasing distance from the front surface; and wherein the second portions of the plurality of bristles converge toward the central axis to form a conical tuft section of the bristle tuft.

13. The oral care implement according to claim 12 wherein opposite sidewalls of the tuft hole urge the first portions of the plurality of bristles into an inclined orientation so that the second portions of the plurality of bristles converge toward the central plane.

14. The oral care implement according to claim 12 further comprising:

the head comprising a plate, the plate comprising a front surface and a rear surface, the front surface of the plate forming at least a portion of the front surface of the head;

the plate comprising the tuft hole; and each of the plurality of bristles comprising a third portion, the third portions of the plurality of bristles fused together to form a unitary mass that anchors the bristle tuft to the plate.

15. The oral care implement according to claim 12 further comprising:

the tuft hole being elongated along the central plane; and wherein the second portions of the plurality of bristles converge toward the central plane to form an elongated wall section having a triangular cross-section taken transverse to the central plane and parallel to the central axis.

16. The oral care implement according to claim 12 wherein the second portions of the plurality of bristles comprise free ends of the plurality of bristles, wherein the free ends of the second portions of the plurality of bristles collectively form a terminal apex of the bristle tuft.

17. The oral care implement according to claim 12 wherein the central axis of the tuft hole is substantially perpendicular to the front surface of the head.

18. An oral care implement comprising:

a head having a front surface and a rear surface;

a tuft hole in the front surface of the head, the tuft hole extending along a central axis; and a bristle tuft formed by a plurality of bristles, each of the plurality of bristles having a first portion disposed within the tuft hole and a second portion protruding from the front surface of the head; and wherein the second portions of the plurality of bristles converge toward a central plane that comprises the central axis with increasing distance from the front surface; and wherein each of the plurality of bristles further comprises a third portion extending from the second portion, the third portions of the plurality of bristles diverging from the central plane.

* * * * *